United States Patent [19]

Pretor et al.

[11] 4,406,565

[45] Sep. 27, 1983

[54] SLIDABLE FILLING DAM

[75] Inventors: Wincenty Pretor, Gliwice; Wojciech Skoczyński, Katowice; Edward Janik, Gliwice; Henryk Zych, Tarnowskie Gory; Ryszard Serwotka, Zabrze, all of Poland

[73] Assignee: Centrum Konstrukcyjnotechnologiczne Maszyn Gorniczych, Gliwice, Poland

[21] Appl. No.: 258,703

[22] Filed: Apr. 29, 1981

[30] Foreign Application Priority Data

Jun. 19, 1980 [PL] Poland ..... 225130

[51] Int. Cl.[3] ..... E02D 15/00

[52] U.S. Cl. ..... 405/258; 405/291; 405/296

[58] Field of Search ..... 405/258, 291-296

[56] References Cited

U.S. PATENT DOCUMENTS 3,831,384 8/1974 Kempster ..... 405/258

FOREIGN PATENT DOCUMENTS 1279025 11/1961 France ..... 405/296

*Primary Examiner*—Dennis L. Taylor

*Attorney, Agent, or Firm*—Ladas & Parry

[57] ABSTRACT

A slidable filling dam has along the heading dam segments (4) articulated in a hinged roof-bar (7) of a mine lining. The slidable dam has near-floor beams (1) which are provided at their ends with terminal eyes (2) to connect two neighboring dam segments (4) at the point of their connection with footings (9) by means of bolts (10, 11). The near-floor beam (1) has in its central part at least one central eye (5) to fix a hydraulic ram (6) pulling up segments (4) of the filling dam.

1 Claim, 2 Drawing Figures

SLIDABLE FILLING DAM

The subject of the invention is a slidable filling dam for mining longwall headings provided with a mechanized lining, designed for filling of post-mining voids.

A dam for a longwall heading, known from the Polish Pat. No. 84289, consists of reproducible vertical structural segments articulated in each roof-bar of a mechanized lining, along the longwall heading. To the lower member of each segment of the dam a beam is attached which is a longitudinal element, and a base which is connected by means of a rigid beam with a longwall conveyor. Tightness of said dam under the roof is ensured by sections of a rubber conveyor belt attached under roof-bars, whereas tightness of the dam at the floor is ensured by rubber aprons attached to the longitudinal beam fixed to the lower member of each segment of the dam. According to this solution, the length of rubber aprons is not much bigger than that of longitudinal beams so that after setting the segments of the dam along the line of the longwall, the ends of rubber aprons attached to neighbouring beams are in half-lap mesh.

Shifting of the dam towards the longwall face is performed in such a menner that all segments of the dam are shifted in succession along the heading, both under the roof and over the floor. However, every next shifts of particular segments of the dam cause forming of a gap at the floor, between longitudinal beams of the shifted segment and those of the unshifted segment. Through said gap of a width of one web, being of about 630 mm, fluid filling material gets into the active part of the longwall heading, this entailing hindrances in production and a considerable hazard to the personnel.

The object of the invention is a slidable filling dam ensuring complete continuity of packing at the floor of the heading.

Said object is attained by connecting dam segments by means of near-floor beams, said near-floor beams being provided at their ends with terminal eyes. In its central part a near-floor beam has central eyes through which a hydraulic ram is attached, said hydraulic ram pulling up segments of the filling dam towards the longwall face. Each near-floor beam connects two dam segments with each other near the floor, along the whole heading. Terminal eyes of two neighbouring near-floor beams and the lower part of a dam segment situated in the vicinity of the floor enter the footing and are connected with the footing by means of bolts. Plays formed at connection points enable deflection of near-floor beams in relation to one another by an angle reaching 30°.

Figure 1:
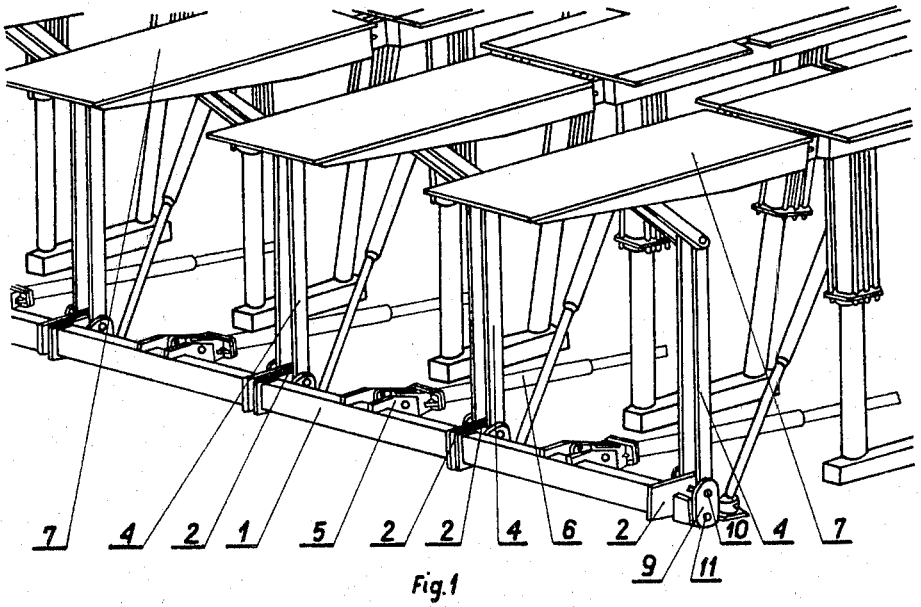
Figure 2:
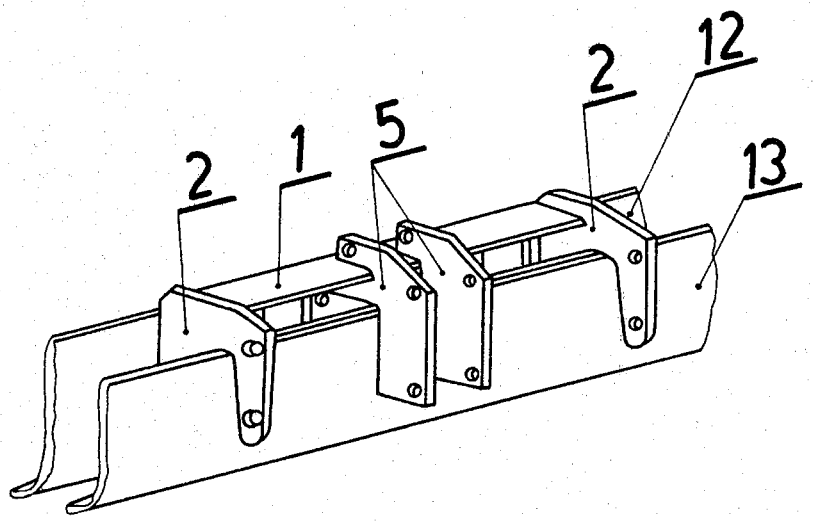

The subject of the invention is presented in its embodiment in a drawing wherein FIG. 1 shows a general view of a lining unit with a slidable filing dam, and FIG. 2 shows a near-floor beam together with packing rubber aprons.

Dam segments 4 of a slidable filling dam are articulated with their upper parts to a hinged roof-bar 7 of a mechanized mining lining. The lower part of the dam segment 4 is connected with a near-floor beam 1 through a terminal eye 2 and a footing 9. The footing 9 encloses terminal eyes 2 of two neighbouring near-floor beams 1 and the lower part of the dam segment 4. The terminal eye 2 and the lower part of the dam segment 4 are connected in a separable manner with the footing by means of bolts 10 and 11. Dam segments 4 of the slidable filling dam are connected near the floor, along the whole heading, through the intermediary of near-floor beams 1 whose ends are provided with terminal eyes 2. In its central part a near-floor beam 1 has central eyes 5 which serve for fixing of a hydraulic ram 6 which enables shifting of dam segments 4 towards the longwall face. To the near-floor beam 1 rubber aprons 12 and 13 are attached, which pack the dam near the floor of the heading. The length of rubber aprons 12 and 13 considerably exceeds the length of one near-floor beam 1, whereby said rubber aprons 12 and 13 are attached at the same time to several or a dozen or so near-floor beams 1 along the heading, this making the dam completely tight near the floor. At shifting of dam segments 4 near-floor beams 1 can deflect in relation to one another by an angle reaching 30°. This is possible due to plays formed at connection points of the terminal eye 2 and the lower part of the dam segment 4 with a footing 9 and bolts 10 and 11. At the moment of shifting dam segments 4 no gap is formed between the shifted segment and the unshifted one. In this way a complete continuity of the dam near the floor of the heading is obtained, in a form of a broken line.

What is claimed is:

1. A slidable filling dam apparatus for mining longwall headings adapted for filling post-mining void regions, said apparatus being mounted on a mine lining apparatus and being movable together with the said lining, said dam apparatus comprising a plurality of vertical support beams comprising vertical beam segments with angularly disposed levers attached to the top thereof, which levers are articulated at one end to a horizontal roof-bar and at the other end to a corresponding vertical beam segment, said vertical beams being provided on their lower ends with a footing device, consisting of two parallel plates connected with each other by a stub wall, a horizontal floor beam connected to the footing of two adjacent linings adjacent the mine floor and secured by means of mounting brackets which have vertical recesses therebetween to allow mounting thereof with said footing, there being with every footing a pair of connected floor beams, a cross bolt connecting a pair of said vertical beams and two of said brackets with said parallel plates of each footing, a second bolt also connecting said parallel plates of each footing, each said floor beam is further provided near its central part with another mounting bracket connected in turn with a hydraulic ram means for shifting of said floor beams together with said mine lining apparatus and said vertical beams and said floor beams having attached thereto a pair of aprons, formed of semi-rigid material, thereby providing a tight wall, beyond which filling materials are packed in the void regions of exploited coal.

* * * * *